US010431881B2

(12) United States Patent
Wu et al.

(10) Patent No.: US 10,431,881 B2
(45) Date of Patent: Oct. 1, 2019

(54) ELECTRONIC APPARATUS AND DUAL BAND PRINTED ANTENNA OF THE SAME

(71) Applicant: PEGATRON CORPORATION, Taipei (TW)

(72) Inventors: Chien-Yi Wu, Taipei (TW); Shih-Keng Huang, Taipei (TW); Chao-Hsu Wu, Taipei (TW); Ya-Jyun Li, Taipei (TW); Chia-Chi Chang, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 497 days.

(21) Appl. No.: 15/410,790

(22) Filed: Jan. 20, 2017

(65) Prior Publication Data

US 2017/0317412 A1 Nov. 2, 2017

(30) Foreign Application Priority Data

Apr. 29, 2016 (TW) ..... 105113498 A

(51) Int. Cl.
*H01Q 1/38* (2006.01)
*H01Q 9/06* (2006.01)
(Continued)

(52) U.S. Cl.
CPC ..... *H01Q 1/38* (2013.01); *H01Q 1/2291* (2013.01); *H01Q 1/48* (2013.01); *H01Q 5/30* (2015.01);
(Continued)

(58) Field of Classification Search
CPC .. H01Q 5/48; H01Q 5/30; H01Q 1/38; H01Q 21/30; H01Q 9/285; H01Q 1/243; H01Q 9/065
See application file for complete search history.

(56) References Cited

U.S. PATENT DOCUMENTS 5,229,782 A * 7/1993 Hemmie ..... H01Q 9/285 343/795
5,532,708 A * 7/1996 Krenz ..... H01Q 9/285 343/795
(Continued)

FOREIGN PATENT DOCUMENTS

TW M301420 U 11/2006
TW 201044694 A 12/2010
(Continued)

*Primary Examiner* — Dameon E Levi
*Assistant Examiner* — Ab Salam Alkassim, Jr.
(74) *Attorney, Agent, or Firm* — McClure, Qualey & Rodack, LLP

(57) ABSTRACT

A dual band printed antenna that includes a substrate including a first and a second surfaces opposite to each other and conductive holes, a first and a second drivers, a first and a second reflectors and a transmission line is provided. The first driver is disposed on the first surface to generate a radiation pattern of a first frequency band. The first reflector is disposed on the first surface and apart from the first driver. The second driver is disposed on the second surface to generate a radiation pattern of a second frequency band and electrically coupled to the first driver through the conductive holes. The reflector is disposed on the second surface, corresponding to a position of the first driver and apart from the second driver. The transmission line is disposed on the first surface and coupled to a feeding point and a ground point of the first driver.

18 Claims, 6 Drawing Sheets

(51) Int. Cl.

| | |
|---|---|
| ***H01Q 5/30*** | (2015.01) |
| ***H01Q 1/48*** | (2006.01) |
| ***H01Q 15/18*** | (2006.01) |
| ***H01Q 1/22*** | (2006.01) |
| ***H01Q 9/28*** | (2006.01) |
| ***H01Q 21/30*** | (2006.01) |
| ***H01Q 5/378*** | (2015.01) |
| ***H01Q 5/48*** | (2015.01) |
| ***H01Q 5/50*** | (2015.01) |

(52) U.S. Cl.
CPC ..... *H01Q 5/378* (2015.01); *H01Q 5/48* (2015.01); *H01Q 5/50* (2015.01); *H01Q 9/065* (2013.01); *H01Q 9/285* (2013.01); *H01Q 15/18* (2013.01); *H01Q 21/30* (2013.01)

(56) References Cited

U.S. PATENT DOCUMENTS 5,914,695 A * 6/1999 Liu ..... H01Q 9/285 343/795
6,018,324 A * 1/2000 Kitchener ..... H01Q 1/38 343/702
6,249,260 B1 * 6/2001 Holloway ..... H01Q 1/38 343/795
6,417,816 B2 * 7/2002 Sadler ..... H01Q 1/243 343/702
6,529,170 B1 * 3/2003 Nishizawa ..... H01Q 1/38 343/700 MS
7,023,909 B1 * 4/2006 Adams ..... H01Q 1/2275 343/865
7,339,529 B2 * 3/2008 Martek ..... H01Q 1/241 343/700 MS
7,362,280 B2 * 4/2008 Shtrom ..... H01Q 3/24 343/795
7,405,699 B2 * 7/2008 Qin ..... H01Q 9/42 343/700 MS
8,089,410 B2 * 1/2012 Shimizu ..... H01Q 1/32 343/700 MS
8,482,473 B2 * 7/2013 Huang ..... H01Q 1/38 343/795
9,287,633 B2 * 3/2016 Tseng ..... H01Q 21/26
10,109,918 B2 * 10/2018 Thill ..... H01Q 1/38
10,135,119 B2 * 11/2018 Ku ..... H01Q 1/243
10,153,557 B2 * 12/2018 Sudo ..... H01Q 9/16
2004/0056805 A1 * 3/2004 Chen ..... H01Q 1/243 343/700 MS
2004/0169612 A1 * 9/2004 Song ..... H01Q 9/26 343/783
2006/0071858 A1 * 4/2006 Suh ..... H01Q 9/28 343/700 MS
2008/0074340 A1 * 3/2008 Song ..... H01Q 1/38 343/816
2008/0129640 A1 * 6/2008 Shtrom ..... H01Q 3/24 343/876
2009/0079653 A1 * 3/2009 Semonov ..... H01Q 1/38 343/793
2009/0128414 A1 * 5/2009 Jeng, Jr. ..... H01Q 9/26 343/700 MS
2009/0207092 A1 * 8/2009 Nysen ..... H01Q 1/2275 343/876
2010/0231463 A1 * 9/2010 Liu ..... H01Q 1/243 343/702
2010/0231477 A1 * 9/2010 Kuramoto ..... H01Q 9/26 343/795
2010/0265151 A1 * 10/2010 Chou ..... H01Q 1/2291 343/843
2011/0037673 A1 * 2/2011 Huang ..... H01Q 5/00 343/793
2011/0063187 A1 * 3/2011 Huang ..... H01Q 1/38 343/893
2011/0090131 A1 * 4/2011 Chen ..... H01Q 19/30 343/815
2011/0193761 A1 * 8/2011 Shinkai ..... H01Q 1/38 343/817
2011/0273336 A1 * 11/2011 Wolf ..... H01Q 9/285 343/700 MS
2012/0139793 A1 * 6/2012 Sharawi ..... H01Q 1/38 343/700 MS
2013/0009836 A1 * 1/2013 Islam ..... H01Q 1/241 343/810
2013/0234896 A1 * 9/2013 Sharawi ..... H01Q 9/0421 343/700 MS
2014/0266902 A1 * 9/2014 Kamgaing ..... H01P 11/00 342/374
2014/0266953 A1 * 9/2014 Yen ..... H01Q 9/065 343/818
2016/0013565 A1 * 1/2016 Ortiz ..... H05K 1/18 343/841
2018/0183147 A1 * 6/2018 Ku ..... H04M 1/026
2019/0173186 A1 * 6/2019 Farzaneh ..... H01Q 1/246

FOREIGN PATENT DOCUMENTS

TW 201145677 A 12/2011
TW 201330383 A 7/2013
TW M456593 U1 7/2013
TW M459543 U1 8/2013
TW I449265 B 8/2014
TW 201511407 A 3/2015
TW I491109 B 7/2015

* cited by examiner

ELECTRONIC APPARATUS AND DUAL BAND PRINTED ANTENNA OF THE SAME

RELATED APPLICATIONS

This application claims priority to Taiwanese Application Serial Number 105113498, filed Apr. 29, 2016, which is herein incorporated by reference.

BACKGROUND

Technology Field

The disclosure relates to an antenna technology. More particularly, the disclosure relates to an electronic apparatus and a dual band printed antenna of the same.

Description of Related Art

Along with the rapid development of the network technology, the electronic communication devices that are able to connect to network become indispensable in our daily life. Simultaneously, the requirements of the design of appearance and the convenience of the portability of the electronic communication devices become higher due to the popularity thereof. In general, in order to shrink the volume of the electronic communication devices, most manufacturers make improvement on the printed antenna. However, not only the adjustment and control of operation frequencies need to be taken into consideration when the electronic communication devices are modified to make improvement, but also the human resource cost spent during the manufacturing process is needed to be evaluated.

Accordingly, it is a great challenge to design shrunk printed antennas under the condition that the normal operation is not affected and manufacturing cost is lowered.

SUMMARY

The invention provides a dual band printed antenna that includes a substrate, a first driver, a first reflector, a second driver, a second reflector and a transmission line. The substrate includes a first surface and a second surface disposed on opposite sides and at least two electrically conductive holes penetrating therethrough. The first driver is disposed on the first surface and configured to generate a first radiation pattern of a first frequency band. The first reflector is disposed on the first surface and apart from the first driver at a first distance. The second driver is disposed on the second surface and configured to generate a second radiation pattern of a second frequency band, wherein the second driver is electrically coupled to the first driver through the at least two electrically conductive holes; a second reflector disposed on the second surface corresponding to the position of the first driver and apart from the second driver at a second distance. The transmission line is disposed on the first surface and electrically coupled to a feed point and a ground point of the first driver.

Another aspect of the present invention is to provide an electronic apparatus that includes a supporting element and at least one dual band printed antenna. The dual band printed antenna is disposed on the supporting element and includes a substrate, a first driver, a first reflector, a second driver, a second reflector and a transmission line. The substrate includes a first surface and a second surface disposed on opposite sides and at least two electrically conductive holes penetrating therethrough. The first driver is disposed on the first surface and configured to generate a first radiation pattern of a first frequency band. The first reflector is disposed on the first surface and apart from the first driver at a first distance. The second driver is disposed on the second surface and configured to generate a second radiation pattern of a second frequency band, wherein the second driver is electrically coupled to the first driver through the at least two electrically conductive holes; a second reflector disposed on the second surface corresponding to the position of the first driver and apart from the second driver at a second distance. The transmission line is disposed on the first surface and electrically coupled to a feed point and a ground point of the first driver.

These and other features, aspects, and advantages of the present invention will become better understood with reference to the following description and appended claims.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1A:
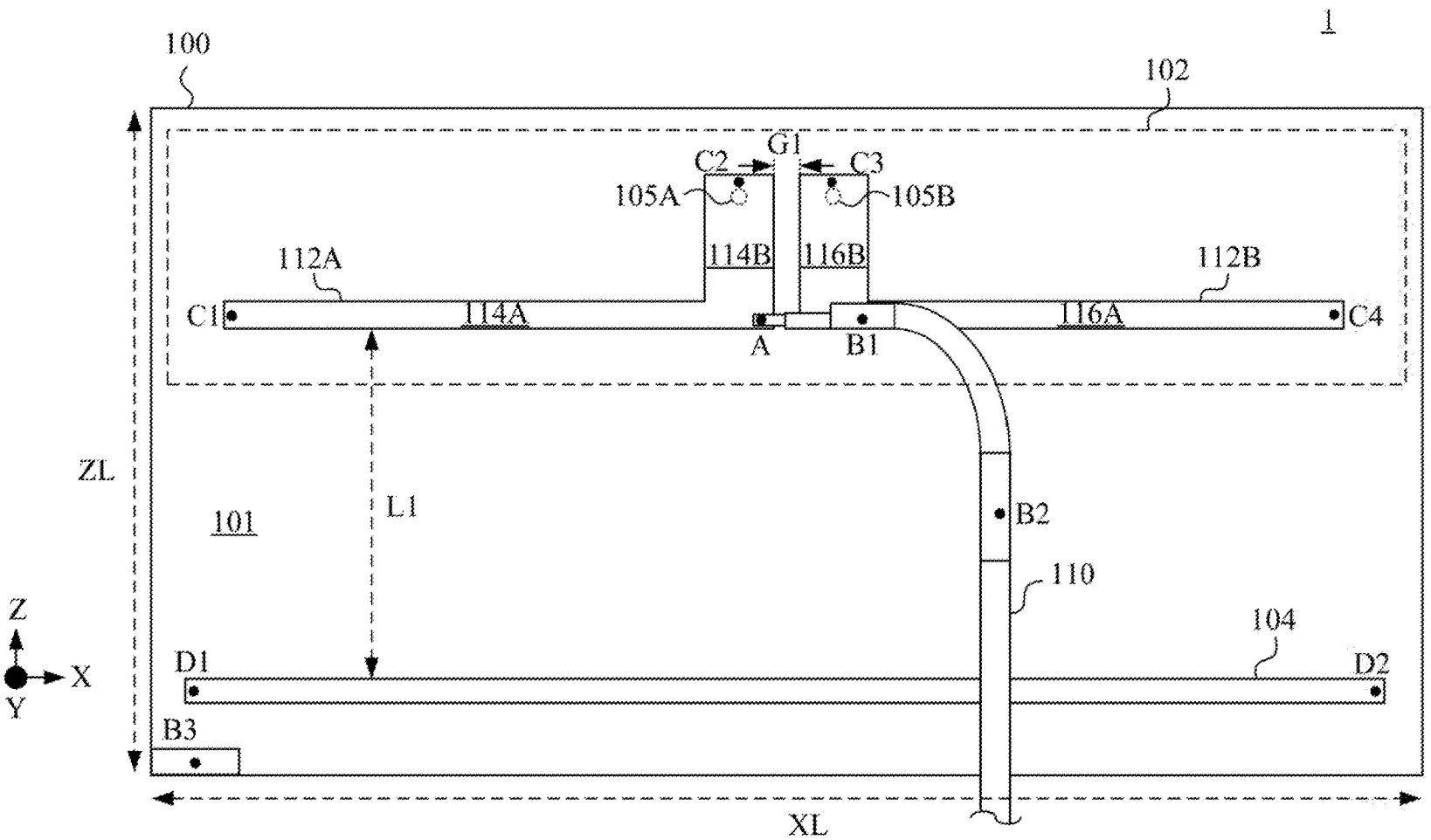
FIG. 1A is a diagram of a top view of a dual band printed antenna in an embodiment of the present invention.

Reference will now be made in detail to the present embodiments of the invention, examples of which are illustrated in the accompanying drawings. Wherever possible, the same reference numbers are used in the drawings and the description to refer to the same or like parts.

As used herein with respect to the "first", "second", . . . , etc., are not particularly alleged order or overall meaning, nor to limit the present invention, it is only the difference between the same technique described in terms elements or operations.

As used herein with respect to "electrically connected" or "coupled" may refer to two or more elements are in direct physical or electrical contact as, or as a solid or indirect mutual electrical contact, and the "power connection" can also refer to two or more elements are in operation or action.

As used herein with respect to the "including", "includes", "having", "containing", etc., are open terms that mean including but not limited to.

The term "and/or" includes the things on any or all combinations used herein.

As used herein with respect to the direction of the term, for example: up, down, left, right, front or rear, etc., only the direction reference to the drawings. Therefore, the direction of the use of terminology is used to describe not intended to limit this creation.

Certain terms used to describe the present application will be discussed below or elsewhere in this specification, in order to provide those skilled in the additional guidance on the description of the present application.

As used herein, the term on the "approximately", "about" etc., to any number of modifications or errors can change slightly, but a slight change or error does not change its nature. In general, such terms of the modified micro-scope changes or errors in some embodiments, be 20%, in some embodiments, may be 10%, and in some embodiments may be 5% or some other value. Those skilled in the art should understand that the above-mentioned value as per needs adjustment, not limited thereto.

Figure 1B:
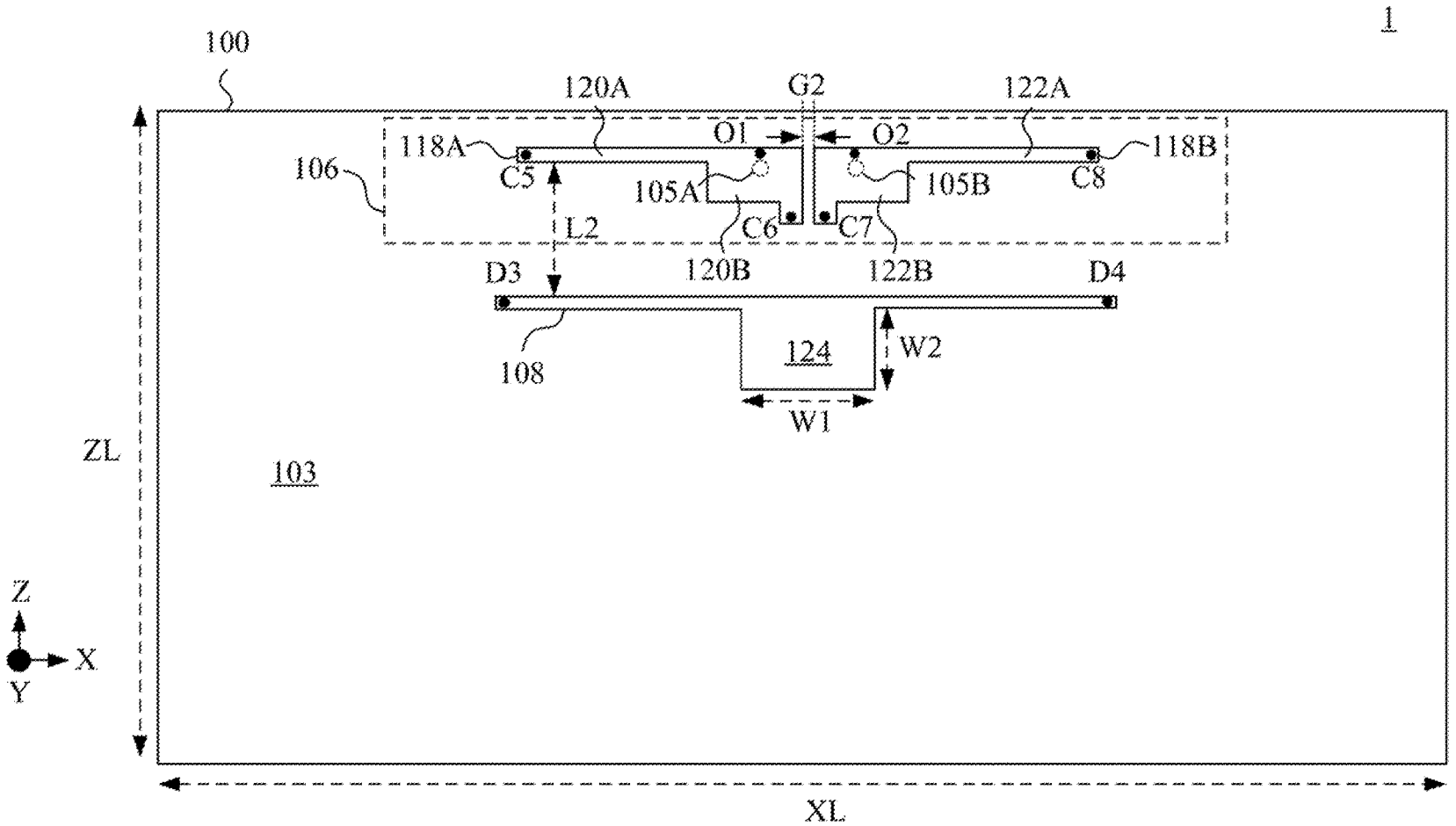
FIG. 1B is a diagram of a bottom view of the dual band printed antenna in FIG. 1A in an embodiment of the present invention.

Reference is now made to FIG. 1A and FIG. 1B. FIG. 1A is a diagram of a top view of a dual band printed antenna 1 in an embodiment of the present invention. FIG. 1B is a diagram of a bottom view of the dual band printed antenna 1 in FIG. 1A in an embodiment of the present invention. The dual band printed antenna 1 includes a substrate 100, a first driver 102, a first reflector 104, a second driver 106, a second reflector 108 and a transmission line 110.

The substrate 100 includes a first surface 101 and a second surface 103 opposite to each other. In FIG. 1A, the first surface 101 of the substrate 100 is illustrated. In FIG. 1B, the second surface 103 of the substrate 100 is illustrated. The substrate further includes two electrically conductive holes 105A and 105B penetrating therethrough.

In an embodiment, the first driver 102, the first reflector 104, the second driver 106 and the second reflector 108 are respectively formed by metal material or any other electrically conductive material. The first driver 102 is disposed on the first surface 101 and is configured to generate a first radiation pattern of a first frequency band. The second driver 106 is disposed on the second surface 103 and configured to generate a second radiation pattern of a second frequency band. In an embodiment, the first frequency band has a resonant frequency of 2.4 GHz and the second frequency band has a resonant frequency of 5 GHz. However, the present invention is not limited thereto.

In the present embodiment, first driver 102 includes a first feed radiation arm 112A and a first ground radiation arm 112B.

The first feed radiation arm 112A includes a first feed path 114A extending from a point C1 to a point A and a second feed path 114B extending from the point A to a point C2. The first ground radiation arm 112B includes a first ground path 116A extending from a point C4 to a point B1 and a second ground path 116B extending from the point B1 to a point C3.

The first feed path 114A and the first ground path 116A stretch along a first direction, such as but not limited to an X direction illustrated in FIG. 1A. The second feed path 114B and the second ground path 116B stretch along a second direction substantially orthogonal to the X direction, such as but not limited to a Z direction illustrated in FIG. 1A. The second feed path 114B and the second ground path 116B are neighboring to each other with a first gap G1 formed therebetween.

In an embodiment, the lengths of the first feed path 114A and the first ground path 116A are respectively a half of a wavelength that a first resonant frequency of the first frequency band corresponds. Take the resonant frequency of 2.4 GHz described above as an example, the length of each of the first feed path 114A and the first ground path 116A is 25 millimeters. However, the value described above is merely an example. The present invention is not limited thereto.

In an embodiment, the first antenna impedance bandwidth of the first driver 102 is adjusted by adjusting a width of the first gap G1 and/or an area of the second feed path 114B and the second ground path 116B. It is appreciated that the area of each of the second feed path 114B and the second ground path 116B is determined by the lengths and widths of the second feed path 114B and the second ground path 116B respectively.

The first reflector 104 is disposed on the first surface 101 and is apart from the first driver 102 at a first distance L1. The first reflector 102 is configured to reflect the first frequency band radiation pattern generated by the first driver 102 to an opposite side of the first driver 102. In an embodiment, the first reflector 104 stretches along the first direction between a point D1 and a point D2 to accomplish the reflecting mechanism to reflect the first frequency band radiation pattern. However, the present invention is not limited thereto.

In an embodiment, the first distance L1 between the first reflector 104 and the first driver 102 is preferably 0.1 to 0.15 times of the wavelength corresponding to a first resonant frequency of the first frequency band. Take the resonant frequency of 2.4 GHz described above as an example, the first distance L1 is 16.7 millimeters. However, the value described above is merely an example. The present invention is not limited thereto.

In an embodiment, the second driver 106 includes a second feed radiation arm 118A and a second ground radiation arm 118B.

The second feed radiation arm 118A includes a third feed path 120A extending from a point C5 to a point O1 and a fourth feed path 120B extending from the point O1 to a point C6. The second ground radiation arm 118B includes a third ground path 122A extending from a point C8 to a point O2 and a fourth ground path 122B extending from the point O2 to a point C7.

The third feed path 120A and the third ground path 122A stretch along a first direction, such as but not limited to an X direction illustrated in FIG. 1A. The fourth feed path 120B and the fourth ground path 122B stretch along a second direction, such as but not limited to a Z direction illustrated in FIG. 1A. The fourth feed path 120B and the fourth ground path 122B are neighboring to each other with a second gap G2 formed therebetween.

In an embodiment, the lengths of the third feed path 120A and the third ground path 122A are respectively a half of a wavelength that a second resonant frequency of the second frequency band corresponds. Take the resonant frequency of 5 GHz described above as an example, the length of each of the third feed path 120A and the third ground path 122A is 11.4 millimeters. However, the value described above is merely an example. The present invention is not limited thereto.

The second feed radiation arm 118A and the second ground radiation arm 118B are electrically coupled to the first feed radiation arm 112A and a first ground radiation arm 112B through the two electrically conductive holes 105A and 105B. In an embodiment, the positions of the electrically conductive holes 105A and 105B substantially correspond to the positions of the point O1 and the point O2. However, the present invention is not limited thereto.

In an embodiment, a second antenna impedance bandwidth of the second driver 106 is adjusted by a width of the second gap G2 and/or an area of the fourth feed path 120B and the fourth ground path 122B. It is appreciated that the area of each of the fourth feed path 120B and the fourth ground path 122B is determined by the lengths and widths of the fourth feed path 120B and the fourth ground path 122B respectively.

The second reflector 108 is disposed on the second surface 103 and is apart from the second driver 106 at a second distance L2. The second driver 106 is configured to reflect the second frequency band radiation pattern generated by the opposite side of the second driver 106. In an embodiment, the second reflector 108 stretches along the first direction between a point D3 and a point D4 to accomplish the reflecting mechanism to reflect the second frequency band radiation pattern. However, the present invention is not limited thereto.

In an embodiment, the second reflector 108 is disposed on a position corresponding to the position of the first driver 102. More specifically, the second reflector 108 and the first driver 102 are disposed at the corresponding positions on opposite sides of the substrate 100 such that the path of the second reflector 108 are overlapped and electrically coupled with the path of the first driver 102 through the substrate.

In an embodiment, the second reflector 108 is apart from the second driver 106 by a second distance L2, which is preferably 0.1 to 0.15 times of the wavelength corresponding to a second resonant frequency of the second frequency band. Take the resonant frequency of 5 GHz described above as an example, the second distance L2 is 6.4 millimeters. However, the value described above is merely an example. The present invention is not limited thereto.

In an embodiment, the second reflector 108 selectively includes a reflective surface 124 disposed at the position of the fourth feed path 120B and the fourth ground path 122B correspondingly. A second impedance bandwidth of the second driver 106 is adjusted by adjusting a length W1 and a width W2 of the reflective surface 124.

The transmission line 110 is disposed on the first surface 101 and is electrically coupled to a feed point A and a ground point B1 of the first driver 102. In an embodiment, the transmission line 110 is a coaxial transmission line including a positive terminal and a negative terminal (not illustrated). The positive terminal is electrically connected to the feed point A and the negative terminal is electrically connected to the ground point B1. Since the first driver 102 is a dipole antenna, the coaxial transmission line can be selectively fixed at a point B2 or a point B3.

As a result, by providing energy to the first driver 102 and the second driver 106 through the positive terminal of the transmission line 110 and by electrically to a system ground plane through the negative terminal, the first frequency band and the second frequency band can be generated by the resonance of the first driver 102 and the second driver 106.

As described above, since the second reflector 108 is disposed at the position corresponding to the position of the first driver 102, the path of the first driver 102 and the path of the second reflector 108 are overlapped and electrically coupled to each other through the substrate. Furthermore, by using such a design, the director is not necessary to be disposed in the dual band printed antenna 1 of the present invention. The radiation patterns of the first driver 102 and the second driver 106 are guided by the first reflector 104 and the second reflector 108 to increase the maximum gain of the antenna.

As a result, the size of the dual band printed antenna 1 of the present invention can be shrunk without affecting the antenna efficiency and the gain of the same. For example, the length XL, the width ZL and the height (not labeled) of the substrate 100 can respectively be 60 millimeters, 30 millimeters and 0.8 millimeters. However, the value described above is merely an example. The present invention is not limited thereto.

Figure 2A:
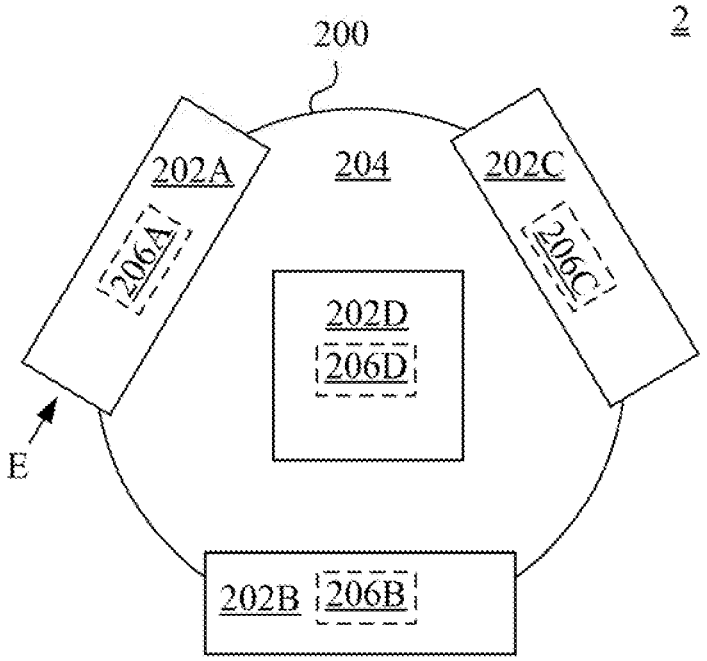
FIG. 2A is a diagram of a top view of an electronic apparatus in an embodiment of the present invention.
Figure 2B:
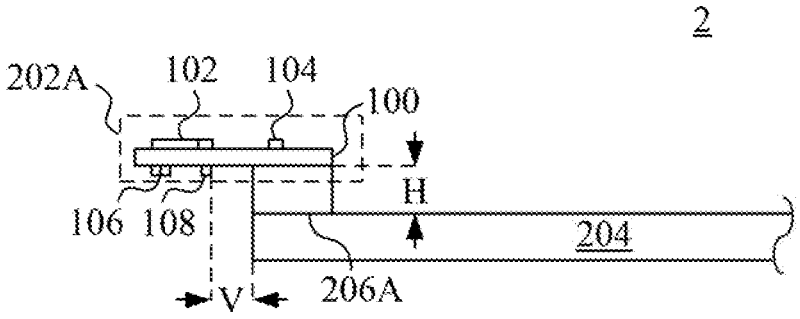
FIG. 2B is a diagram of a side view of the electronic apparatus along the direction E in FIG. 2A in an embodiment of the present invention.

Reference is now made to FIG. 2A and FIG. 2B. FIG. 2A is a diagram of a top view of an electronic apparatus 2 in an embodiment of the present invention. FIG. 2B is a diagram of a side view of the electronic apparatus 2 along the direction E in FIG. 2A in an embodiment of the present invention.

The electronic apparatus 2 includes a supporting element 200 and four dual band printed antennas 202A-202D. Each of the dual band printed antennas 202A-202D can be implemented by the dual band printed antenna 1 illustrated in FIG. 1. In FIG. 2B, only the supporting element 200 and the dual band printed antenna 202A are illustrated. The dual band printed antenna 202A includes the first driver 102, the first reflector 104, the second driver 106, the second reflector 108 and the transmission line 110 illustrated in FIG. 1.

In an embodiment, the supporting element 200 is a round shape and includes a metal plate 204 and electrically isolating elements 206A-206D (illustrated with dashed lines in FIG. 2A). The dual band printed antennas 202A-202D are correspondingly disposed on the electrically isolating elements 206A-206D.

In an embodiment, other circuit components (not illustrated) of the electronic apparatus 2 can be disposed on a side of the metal plate 204 opposite to the dual band printed antennas 202A-202D. As a result, the metal plate 204 provides the dual band printed antennas 202A-202D a shielding effect against the other circuit components of the electronic apparatus 2. The electrical interference on the dual band printed antennas 202A-202D from the other circuit components can be avoided.

In the present embodiment, the dual band printed antennas 202A-202C are disposed at an edge of the supporting element apart from each other by 120 degrees. The dual band printed antenna 202D is disposed at a central region of a surface of the supporting element 200 to enhance the signal strength along the Z direction.

As illustrated in FIG. 2B, the electrically isolating element 206A keeps the first driver 102 and the edge of the metal plate 204 apart by a vertical distance H and a horizontal distance V.

Figure 3:
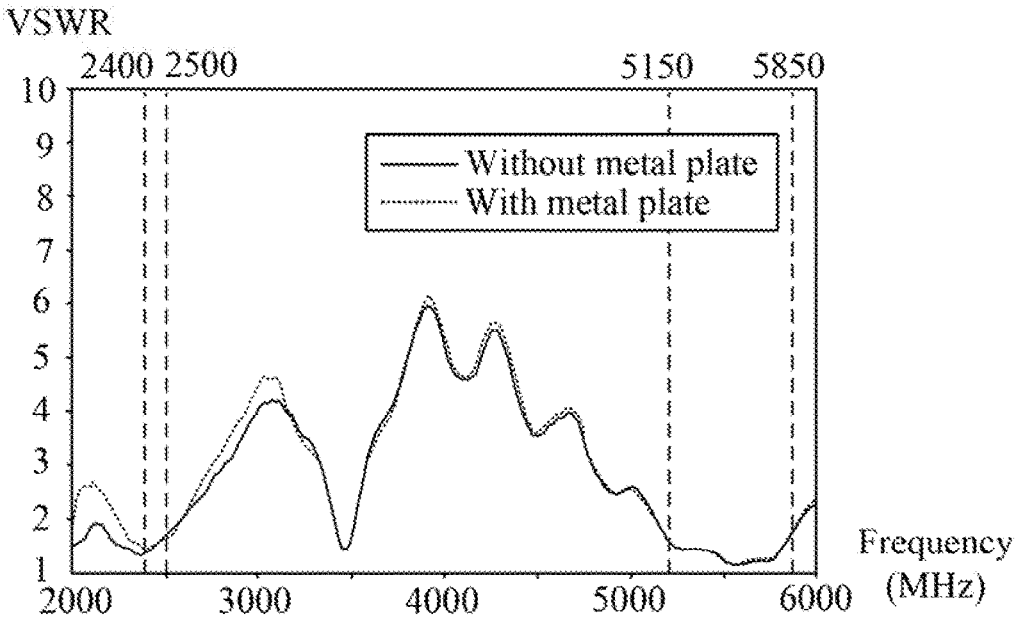
FIG. 3 is a diagram illustrating the voltage standing wave ratio of the dual band printed antenna in an embodiment of the present invention.

Reference is now made to FIG. 3. FIG. 3 is a diagram illustrating the voltage standing wave ratio (VSWR) of the dual band printed antenna (e.g. the dual band printed antenna 1 in FIG. 1 or the dual band printed antennas 202A-202D in FIG. 2A) in an embodiment of the present invention. The X-axis of the diagram stands for the frequency (unit: MHz) and the Y-axis of the diagram stands for the VSWR. The curve illustrated in thick line corresponds to the dual band printed antenna without the metal plate and the curve illustrated in dashed line corresponds to the dual band printed antenna with the metal plate.

In an embodiment, when vertical distance H between the first driver 102 and the edge of the metal plate 204 is 10 millimeters and the horizontal distance V between the first driver 102 and the edge of the metal plate 204 is 5 millimeters, the influence of the metal plate 204 on the dual band printed antenna 202A is the least. As illustrated in FIG. 3, during the resonant frequency band between 2400-2500 MHz and 5150-5850 MHz, the VSWR curves of the dual band printed antenna without the metal plate and the dual band printed antenna with the metal plate are almost overlapped.

Figure 4A:
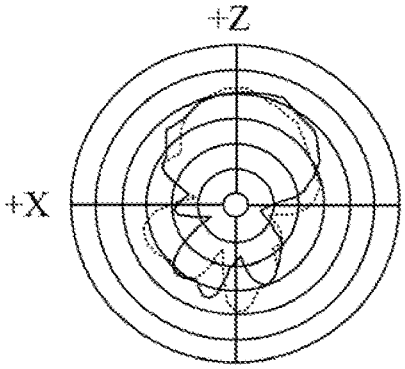
FIGS. 4A-4C are diagrams of the radiation patterns of the dual band printed antenna without the metal plate in an embodiment of the present invention.
Figure 5A:
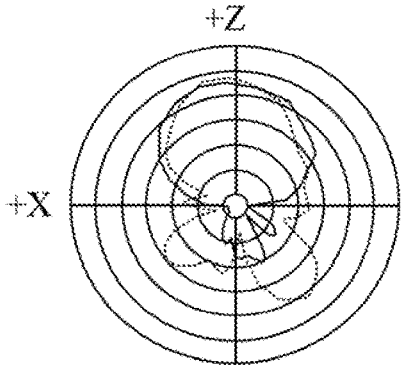
FIGS. 5A-5C are diagrams of the radiation patterns of the dual band printed antenna with the metal plate in an embodiment of the present invention.
Figure 4B:
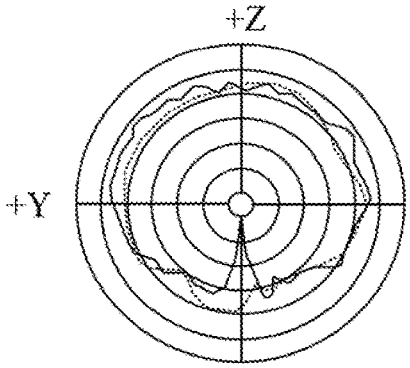
Figure 5B:
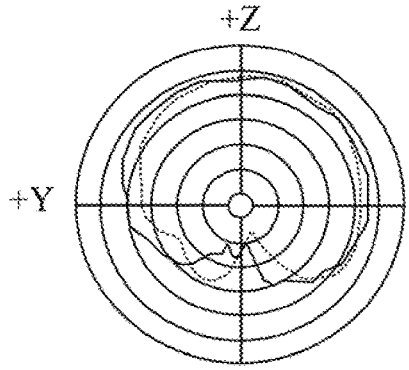
Figure 4C:
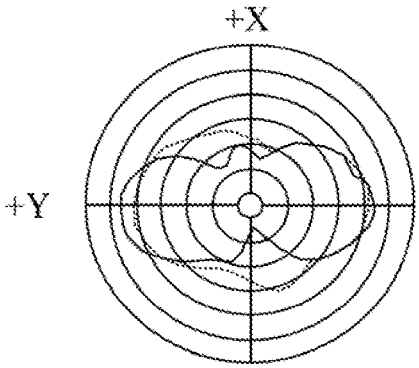
Figure 5C:
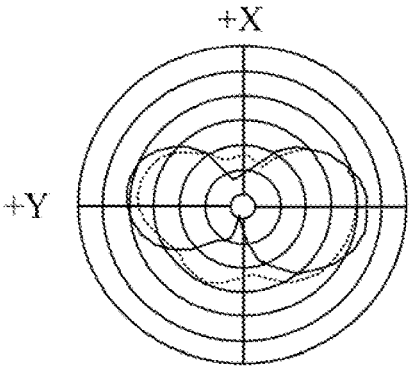

Reference is now made to FIGS. 4A-4C and FIGS. 5A-5C. FIGS. 4A-4C are diagrams of the radiation patterns of the dual band printed antenna without the metal plate in an embodiment of the present invention. FIGS. 5A-5C are diagrams of the radiation patterns of the dual band printed antenna with the metal plate in an embodiment of the present invention.

FIG. 4A and FIG. 5A are the radiation patterns on the X-Z plane when the ϕ-axis angle is 0 degree. FIG. 4B and FIG. 5B are the radiation patterns on the X-Z plane when the ϕ-axis angle is 90 degrees. FIG. 4C and FIG. 5C are the radiation patterns on the X-Y plane when the θ-axis angle is 90 degrees. The curve illustrated in a thick line corresponds to the resonant frequency of 5470 MHz and the curve illustrated in a dashed line corresponds to the resonant frequency of 2442 MHz.

Table 1 illustrated in the following paragraph shows the antenna efficiencies and the maximum gains of the dual band printed antenna with and without the metal plate under different frequencies in an embodiment of the present invention.

| Frequency (MHz) | Efficiency (dB) | Efficiency (dB) | Maximum gain (dBi) |
|---|---|---|---|
| Without Metal plate | | | |
| 2300 | 74 | −1.33 | 3.33 |
| 2350 | 74 | −1.29 | 3.00 |
| 2400 | 71 | −1.51 | 2.86 |
| 2442 | 67 | −1.72 | 2.61 |
| 2484 | 68 | −1.64 | 3.10 |
| 2500 | 68 | −1.65 | 3.02 |
| 5150 | 55 | −2.56 | 2.92 |
| 5250 | 63 | −2.00 | 4.80 |
| 5350 | 71 | −1.51 | 5.33 |
| 5470 | 67 | −1.77 | 4.39 |
| 5725 | 66 | −1.83 | 3.86 |
| 5785 | 62 | −2.06 | 3.65 |
| 5875 | 56 | −2.55 | 3.11 |
| With Metal plate | | | |
| 2300 | 69 | −1.61 | 3.82 |
| 2350 | 70 | −1.52 | 4.16 |
| 2400 | 71 | −1.47 | 4.35 |
| 2442 | 65 | −1.86 | 3.90 |
| 2484 | 66 | −1.84 | 3.87 |
| 2500 | 69 | −1.61 | 4.02 |
| 5150 | 55 | −2.57 | 2.88 |
| 5250 | 61 | −2.15 | 3.16 |
| 5350 | 67 | −1.77 | 3.66 |
| 5470 | 69 | −1.60 | 3.90 |
| 5725 | 64 | −1.92 | 4.26 |
| 5785 | 60 | −2.20 | 3.87 |
| 5875 | 65 | −2.59 | 3.67 |

Based on FIGS. 4A-4C, FIGS. 5A-5C and Table 1, it is known that no matter the metal plate is presented or not, the performance of the maximum gain corresponding to the resonant frequency of 2.4 GHz on the X-Z plane of the dual band printed antenna is the most obvious. The antenna efficiencies corresponding to the resonant frequency of 2.4 GHz are all above 65%, and the maximum gains are larger than 2.5 dBi. The antenna efficiencies corresponding to the resonant frequency of 5 GHz are all above 55%, and the maximum gains are larger than 2.5 dBi.

It is appreciated that the number and the positions of the dual band printed antennas included in the electronic apparatus illustrated in FIG. 2A are merely an example. In other embodiments, the number and the positions of the dual band printed antennas can be adjusted according to practical requirements and are not limited to those illustrated in FIG. 2A.

Figure 6:
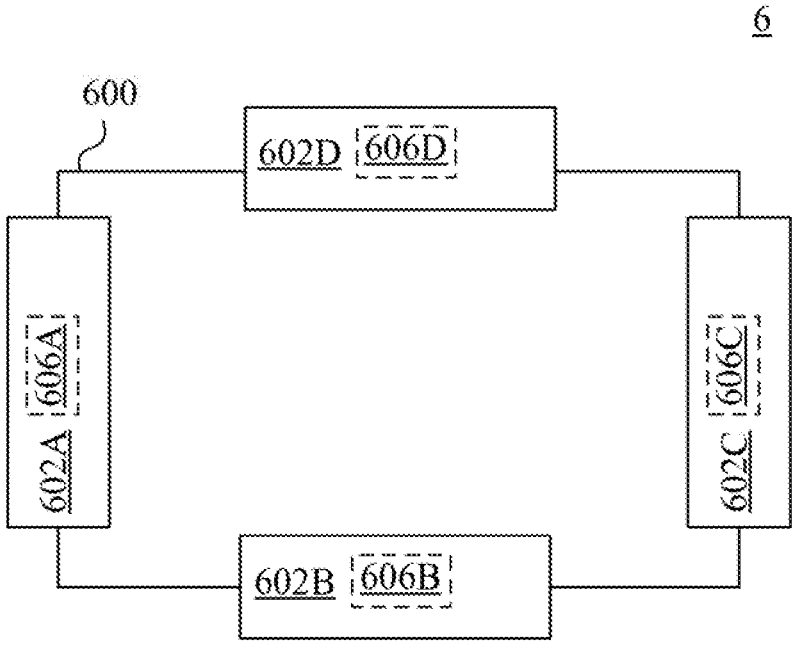
FIG. 6 is a diagram of a top view of an electronic apparatus in an embodiment of the present invention.

Reference is now made to FIG. 6. FIG. 6 is a diagram of a top view of an electronic apparatus 6 in an embodiment of the present invention. The electronic apparatus 6 includes a supporting element 600 and four dual band printed antennas 602A-602D. Each of the dual band printed antennas 602A-602D can be implemented by the dual band printed antenna 1 illustrated in FIG. 1.

In an embodiment, the supporting element 600 is a quadrilateral and includes electrically isolating elements 604A-604D (illustrated by using dashed line in FIG. 6). The dual band printed antennas 602A-602D are correspondingly disposed on the electrically isolating elements 604A-604D.

In the present embodiment, the dual band printed antennas 602A-602D are disposed at four edges of the supporting element 600. Comparing to the disposition of the dual band printed antennas 202A-202D illustrated in FIG. 2A, each of the dual band printed antennas 602A-602D in the present embodiment is responsible for the delivering and receiving range of 90 degrees. The VSWR of the dual band printed antennas 602A-602D is substantially the same as the VSWR of the dual band printed antennas 202A-202D illustrated in FIG. 2A.

As a result, the dual band printed antenna of the present invention can be arranged in different ways in the electronic apparatus to accomplish the omnidirectional signal transmission and reception without interfering each other.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A dual band printed antenna comprising:

a substrate comprising a first surface and a second surface opposite to each other and at least two electrically conductive holes penetrating therethrough;

a first driver disposed on the first surface and configured to generate a first radiation pattern of a first frequency band;

a first reflector disposed on the first surface and apart from the first driver at a first distance;

a second driver disposed on the second surface and configured to generate a second radiation pattern of a second frequency band, wherein the second driver is electrically coupled to the first driver through the at least two electrically conductive holes;

a second reflector disposed on the second surface corresponding to the position of the first driver and apart from the second driver by a second distance; and a transmission line disposed on the first surface and electrically coupled to a feed point and a ground point of the first driver.

2. The dual band printed antenna of claim 1, wherein the first driver comprises a first feed radiation arm and a first ground radiation arm corresponding to the feed point and the ground point respectively, the second driver comprises a second feed radiation arm and a second ground radiation arm electrically coupled to the first feed radiation arm and the first ground radiation arm through the at least two electrically conductive holes respectively.

3. The dual band printed antenna of claim 2, wherein the first feed radiation arm comprises a first feed path and a second feed path, and the first ground radiation arm comprises a first ground path and a second ground path, wherein the first feed path and the first ground path stretch along a first direction, the second feed path and the second ground path stretch along a second direction substantially orthogonal to the first direction, and the second feed path and the second ground path are neighboring to each other with a first gap formed therebetween.

4. The dual band printed antenna of claim 3, wherein the second feed radiation arm comprises a third feed path and a fourth feed path, and the second ground radiation arm comprises a third ground path and a fourth ground path, wherein the third feed path and the third ground path stretch along the first direction, the third feed path and the fourth ground path stretch along the second direction, and the fourth feed path and the fourth ground path are neighboring to each other with a second gap formed therebetween.

5. The dual band printed antenna of claim 4, wherein the lengths of the first feed path and the first ground path are respectively a half of a wavelength that a first resonant frequency of the first frequency band corresponds, the lengths of the second feed path and the second ground path are respectively a half of a wavelength that a second resonant frequency of the second frequency band corresponds.

6. The dual band printed antenna of claim 5, wherein the first driver is a 2.4 GHz dipole antenna and the second driver is a 5 GHz dipole antenna, the lengths of the first feed radiation arm and the first ground radiation arm are respectively 25 millimeters, and the lengths of the second feed radiation arm and the second ground radiation arm are respectively 11.4 millimeters.

7. The dual band printed antenna of claim 4, wherein a first antenna impedance bandwidth of the first driver is adjusted by adjusting a width of the first gap and/or an area of the second feed path and the second ground path, and a second antenna impedance bandwidth of the second driver is adjusted by a width of the second gap and/or an area of the fourth feed path and the fourth ground path.

8. The dual band printed antenna of claim 4, wherein the second reflector comprises a reflective surface disposed at the position of the fourth feed path and the fourth ground path correspondingly, and a second impedance bandwidth of the second driver is adjusted by adjusting a length and a width of the reflective surface.

9. The dual band printed antenna of claim 1, wherein the first distance is 0.1 to 0.15 times of a first wavelength corresponding to a first resonant frequency of the first frequency band, and the second distance is 0.1 to 0.15 times of a second wavelength corresponding to a second resonant frequency of the second frequency band.

10. The dual band printed antenna of claim 8, wherein the first driver is a 2.4 GHz dipole antenna and the second driver is a 5 GHz dipole antenna, the lengths of the first feed radiation arm and the first ground radiation arm are respectively 16.7 millimeters, and the lengths of the second feed radiation arm and the second ground radiation arm are respectively 6.4 millimeters.

11. The dual band printed antenna of claim 1, wherein the transmission line is a coaxial transmission line comprising a positive terminal and a negative terminal, wherein the positive terminal is electrically coupled to the feed point and the negative terminal is electrically coupled to the ground point.

12. The dual band printed antenna of claim 1, wherein a length, a width and a height of the substrate are 60 millimeters, 30 millimeters and 0.8 millimeters respectively.

13. An electronic apparatus comprising:

a supporting element; and at least one dual band printed antenna disposed on the supporting element and comprising:

a substrate comprising a first surface and a second surface opposite to each other and at least two electrically conductive holes penetrating therethrough;

a first driver disposed on the first surface and configured to generate a first radiation pattern of a first frequency band;

a first reflector disposed on the first surface and apart from the first driver at a first distance;

a second driver disposed on the second surface and configured to generate a second radiation pattern of a second frequency band, wherein the second driver is electrically coupled to the first driver through the at least two electrically conductive holes;

a second reflector disposed on the second surface corresponding to the position of the first driver and apart from the second driver by a second distance; and a transmission line disposed on the first surface and electrically coupled to a feed point and a ground point of the first driver.

14. The electronic apparatus of claim 13, wherein the supporting element comprises a metal plate and at least one electrically isolating element, wherein the electrically isolating element is disposed at an edge of the metal plate and the dual band printed antenna is disposed on the electrically isolating element.

15. The electronic apparatus of claim 14, wherein the at least one electrically isolating element keeps the first driver and the edge of the metal plate apart by a vertical distance and a horizontal distance.

16. The electronic apparatus of claim 15, wherein the vertical distance is 10 millimeters and the horizontal distance is 5 millimeters.

17. The electronic apparatus of claim 13, wherein the supporting element is a round shape and a number of the dual band printed antenna is four, wherein three of the dual band printed antennas are disposed at an edge of the supporting element apart from each other by 120 degrees and one of the dual band printed antennas is disposed at a central region of a surface of the supporting element.

18. The electronic apparatus of claim 13, wherein the supporting element is a quadrilateral and a number of the dual band printed antenna is four, wherein the dual band printed antennas are disposed at four edges of the supporting element.

* * * * *